US008736429B2

(12) United States Patent
Lien et al.

(10) Patent No.: US 8,736,429 B2
(45) Date of Patent: May 27, 2014

(54) GREETING CARD WITH SUBSEQUENT AUDIO AFTER CLOSING

(75) Inventors: Timothy J. Lien, Lenexa, KS (US); John B. Watkins, Independence, MO (US); Robert D. Wertanen, Parkville, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 199 days.

(21) Appl. No.: 12/847,809

(22) Filed: Jul. 30, 2010

(65) Prior Publication Data

US 2010/0308981 A1 Dec. 9, 2010

(51) Int. Cl.

| | |
|---|---|
| ***G08B 3/00*** | (2006.01) |
| ***G08B 13/08*** | (2006.01) |
| ***E04F 10/00*** | (2006.01) |
| ***G09F 1/00*** | (2006.01) |

(52) U.S. Cl.

USPC ..... 340/384.1; 116/85; 160/49; 40/124.03; 40/124.11; 40/124.12; 40/124.01

(58) Field of Classification Search

USPC ..... 340/384.1; 348/500

See application file for complete search history.

(56) References Cited

U.S. PATENT DOCUMENTS

| | | | | |
|---|---|---|---|---|
| 4,703,573 | A * | 11/1987 | Montgomery et al. | 40/455 |
| 5,153,579 | A * | 10/1992 | Fisch et al. | 340/7.52 |
| 6,064,855 | A | 5/2000 | Ho | |
| 2002/0186131 | A1 * | 12/2002 | Fettis | 340/568.1 |
| 2003/0170604 | A1 * | 9/2003 | Mullen | 434/317 |
| 2005/0024221 | A1 * | 2/2005 | Jamison-Lenz et al. | 340/686.1 |
| 2006/0038663 | A1 * | 2/2006 | Steinetz et al. | 340/392.1 |
| 2007/0256337 | A1 * | 11/2007 | Segan | 40/124.03 |
| 2008/0275706 | A1 * | 11/2008 | Paulini | 704/272 |
| 2010/0009727 | A1 * | 1/2010 | Presutti | 455/575.1 |
| 2010/0052876 | A1 * | 3/2010 | Clegg et al. | 340/384.1 |

* cited by examiner

*Primary Examiner* — Jennifer Mehmood
*Assistant Examiner* — Pameshanand Mahase
(74) *Attorney, Agent, or Firm* — Shook, Hardy & Bacon L.L.P.

(57) ABSTRACT

A greeting card having an audio message and playback device delivers a first sound recording upon opening of the greeting card and a second sound recording upon closing of the greeting card. The delivery of each sound recording may be delayed by a timing component within the audio message and playback device. Additionally, the delivery of each sound recording may be played simultaneously or in queue. Sound recordings may also be recorded by a user using a recording component that is in addition to the audio message and playback device. The audio message and playback device may also include an additional trial mode component that allows the user to test a recorded message before purchasing the greeting card and place the greeting card into a use mode that allows the user to permanently record the message.

20 Claims, 5 Drawing Sheets

GREETING CARD WITH SUBSEQUENT AUDIO AFTER CLOSING

CROSS-REFERENCE TO RELATED APPLICATIONS

Not applicable.

STATEMENT REGARDING FEDERALLY SPONSORED RESEARCH OR DEVELOPMENT

Not applicable.

BRIEF SUMMARY OF THE INVENTION

The present invention relates to a greeting card with an audio component. In particular, this invention relates to a greeting card that delivers an initial audio recording upon opening of the greeting card and a second audio recording that plays upon closing of the greeting card. Additionally, the audio recording played in response to the opening and closing of the greeting card may depend on the timing of the opening and closing of the greeting card.

As greeting cards that play sounds upon opening have become increasingly popular, some consumers have come to expect to hear sounds when a greeting card opens. However, consumers don't expect a greeting card to play a sound once the greeting card has been closed. Additionally, most consumers have come to expect that once a greeting card has played a song upon opening, there is not another sound recording to be heard. As such, consumers would be surprised to hear a second recording, such as a song, once a greeting card has been closed.

Further objects, features and advantages of the present invention over the prior art will become apparent from the detailed description of the drawings which follows, when considered with the attached figures.

BRIEF DESCRIPTION OF THE SEVERAL VIEWS OF THE DRAWING

The features of the invention noted above are explained in more detail with reference to the embodiments illustrated in the attached drawing figures, in which like reference numerals denote like elements, in which FIGS. 1-6 illustrate one possible embodiment of the present invention, and in which:

FIG. 1 is a perspective view of an exterior of a greeting card in a mostly closed position and constructed in accordance with an embodiment of the present invention;

FIG. 2 is a perspective view of an interior of the greeting card of FIG. 1 in an open position;

FIG. 3 is a side elevation view of the interior of the greeting card of FIG. 2 with a portion of a cover panel cut-away to reveal certain internal components of the greeting card;

FIG. 4 is a perspective view of an interior of a greeting card in an open position with a recording component and a trial mode component in accordance with another embodiment of the present invention;

FIG. 5 is a side elevation view of the interior of the greeting card of FIG. 4 with a portion of a cover panel cut-away to reveal certain internal components of the greeting card; and FIG. 6 is a perspective view of an exterior of a mostly closed greeting card playing an audio recording subsequent to closing in accordance with embodiments of the present invention.

DETAILED DESCRIPTION OF THE INVENTION

Figure 1:
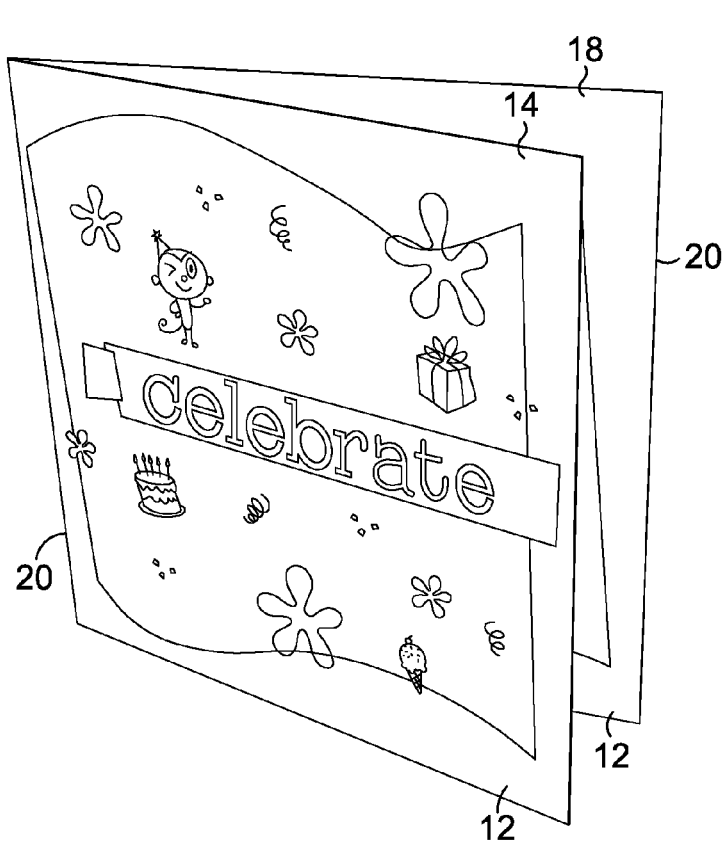

Referring now to the drawings in more detail and initially to FIG. 1, numeral 10 generally designates a greeting card constructed in accordance with embodiments of the present invention. The greeting card 10 includes a card body 12. In the illustrated embodiments, the card body 12 includes a front panel 14, a back panel 16, and an interior cover 18. As readily understood by one of ordinary skill in the art, the card body 12 may consist of a single piece of card stock that has been folded along fold lines 20 to provide the panels 14, 16, and 18, as depicted in the illustrated embodiments. It is also readily understood by one of ordinary skill in the art that the panels 14, 16, and 18 may be individual panels that are joined to one another by any number of methods known in the art and that the card body 12 could have any number of panels. Each of the panels 14, 16, and 18 have two sides or faces that can be called interior or exterior or inner or outer, depending on its orientation.

Figure 2:
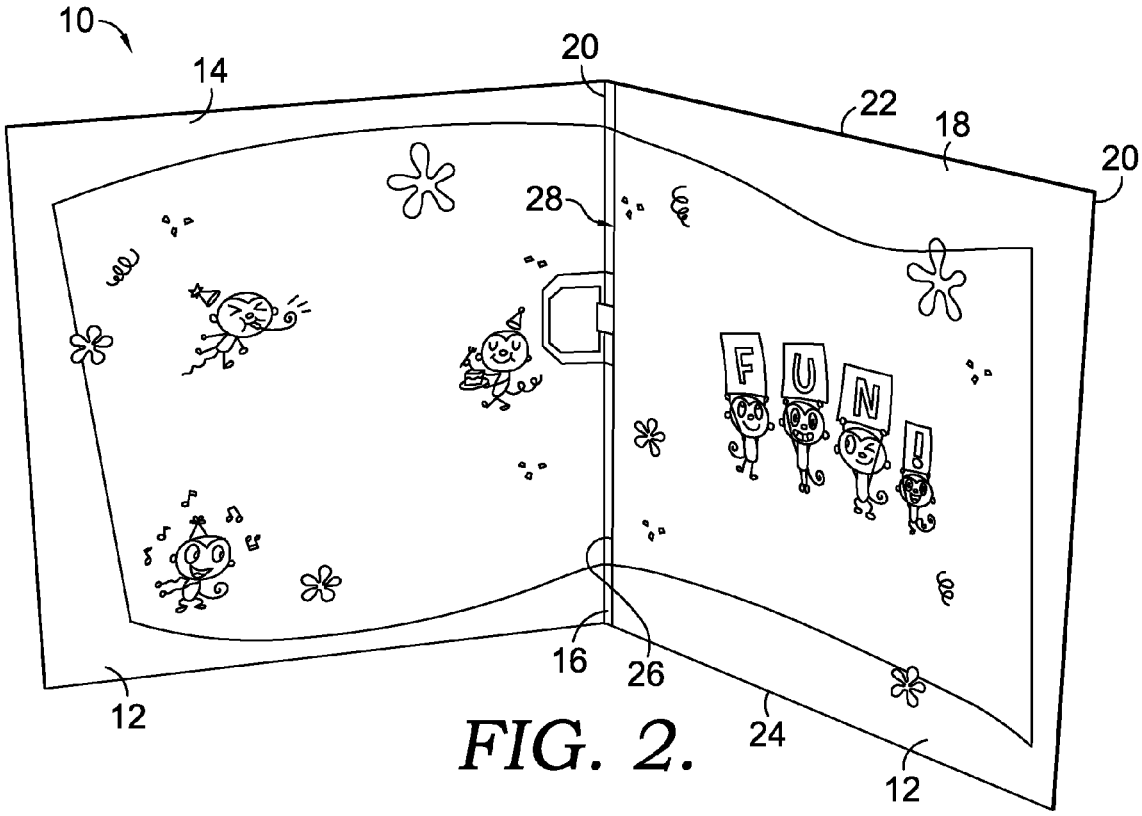

In the illustrated embodiment shown in FIG. 2, the interior cover panel 18 has been folded back along fold line 20 such that it overlies the back panel 16. The interior cover panel 18 and the back panel 16 have been secured together along an upper edge 22 of the card body 12 and along a lower edge 24 of the card body 12. An edge 26 of the interior cover panel 18 has been left unsecured to the back panel 16. As such, the interior cover panel 18 and the back panel 16 define a pocket 28 into which an audio message playback device 30 may be positioned. In particular, the pocket 28 defines a cavity formed between the interior cover panel 18 and the back panel 16.

Figure 3:
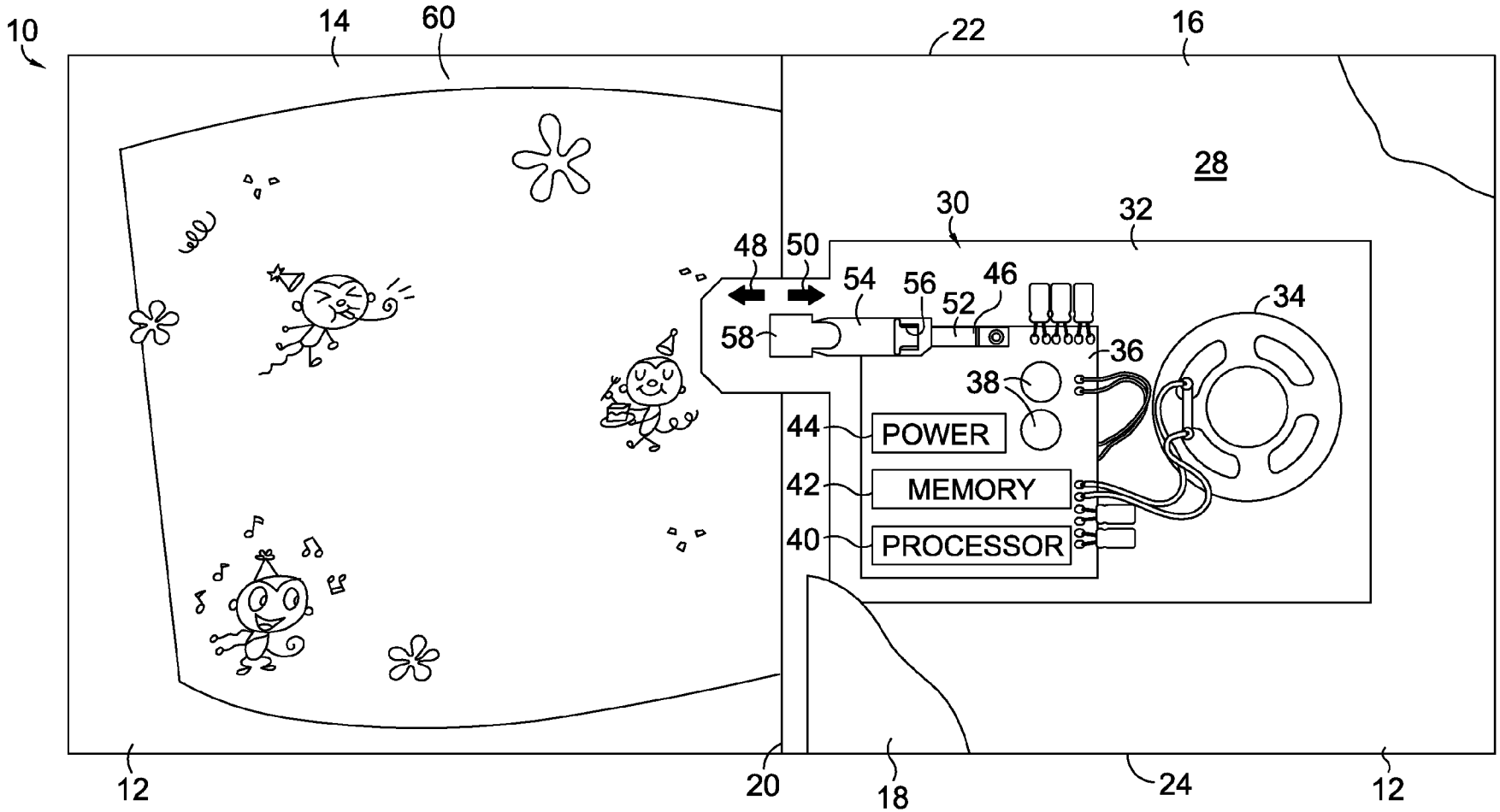

Turning now to FIG. 3, the audio message playback device 30 is illustrated. The audio message playback device 30, for ease of manufacture and assembly of the greeting card 10, may be provided on a carrier 32. The carrier 32 may be formed from a flat, rigid material, such as paper board, plastic or cardstock, that is able to hold components of the audio message playback device 30. The carrier 32 can then be adhered to inner surfaces of the front and back panels 14, 16. Alternatively, the components of the audio message playback device 30 may be individually positioned inside the pocket 28 and directly on the card body 12.

The audio message playback device 30 includes a speaker 34, a circuit board 36, integrated circuits 38, a processor 40, a memory 42, a power supply 44, and a first switch 46. In the illustrated embodiment shown in FIG. 3, the audio message playback device 30 includes two separate integrated circuits 38. The two separate integrated circuits 38 could be replaced by a single integrated circuit having the functionality discussed herein. Additionally, processor 40 may be incorporated into integrated circuits 38. Further, one integrated circuit with processor function may be used with a separate memory chip instead of, or in addition to, memory 42. In addition to the electrical components mentioned, which are coupled to the circuit board 36, other electrical components may be coupled with the circuit board as would be readily understood and appreciated by one of ordinary skill in the art.

The first switch 46 is implemented as a slide switch 46 that is opened 48 and closed 50, respectively. The slide switch 46 includes a contact arm 52 which is biased into a contact surface (not shown) on the circuit board 36. The slide switch 46 also includes a slide tab 54 that is movable between a first position (closed 50), where a portion of the slide tab 54 is intermediate the contact arm 52 and the contact surface of the circuit board 36, thereby creating an open circuit, and a second position (opened 48), illustrated in FIG. 3, where the greeting card 10 is in an open position and an aperture 56 in the slide tab 54 permits the contact arm 52 to abut the contact surface of the circuit board 36, thereby creating a closed circuit. A proximal end 58 of the slide tab 54 may be secured to a portion of the carrier 32 that is positioned over the inner surface 60 of the front panel 14, whereby movement of the front panel 14 away from the interior cover panel 18 (i.e., opening the greeting card 10) pulls the slide tab 54 out from between the contact arm 52 and the contact surface of the circuit board 36. When the greeting card 10 is opened 48, a first signal is provided to the processor 40 to indicate that the first switch 46 has been activated. The first signal may be generated by a card status detector within the audio message and playback device 30. In this embodiment, the audio message playback device 30 is continually powered by the power supply 44 in order to detect when the greeting card 10 has been opened 48 or closed 50. In alternative embodiments, either position 48, 50 of the first switch 46 or both positions may initiate power to the audio message playback device 30. In response to the first signal that the first switch 46 has been activated, the processor 40 retrieves a first sound recording from the memory 42 within the audio message playback device 30. The first sound recording is then played from the speaker 34. Additionally, a timing component may be used to delay the playback of the first sound recording. For example, the timing component may delay the playing of the first sound recording for 15 seconds after the greeting card 10 has been opened 48. The timing component may be within the processor 40.

Movement of the front interior panel 14 towards the interior cover panel 18 (i.e., closing the greeting card 10) moves the slide tab 54 back between the contact arm 52 and the contact surface of the circuit board 36. When the greeting card 10 is closed 50, a second signal is provided to the processor 40 to indicate that the switch 46 has again been activated. The second signal may be generated by the card status detector within the audio message and playback device 30. In response to this second signal, the processor 40 retrieves a second sound recording from the memory 42 within the audio message playback device 30. The second sound recording is then played from the speaker 34. As with the first sound recording, the second sound recording may be delayed through the use of timing component within the processor 40. For example, the timing component may delay the playing of the second sound recording for 5 seconds after the greeting card 10 has been closed 50.

The greeting card 10 may include multiple pre-recorded sound recordings to play in response to the opening and closing of the greeting card 10. In particular, the sound recordings may include songs, vocal recordings, or other noises to be played when the greeting card 10 is opened 48 and closed 50. Additionally, the sound recordings may be stored in the memory 42 of the audio message playback device 30. The collection of sound recordings within the memory 42 may be augmented or edited in accordance with user preferences. For instance, the user may record personal messages that may be stored in the memory 42 of the audio message playback device 30 in accordance with embodiments discussed further below.

In an illustrative embodiment, a first sound recording may be played in response to a greeting card 10 being opened 48 and a second sound recording may be played in response to a greeting card 10 being closed 50. The selection of the first sound recording and the second sound recording may be sequential, randomized, or a combination thereof. Further, the second sound recording may be dependent upon the first sound recording. Further, multiple sound recordings may be played in response to a greeting card 10 being closed 50. For example, a second sound recording, as discussed above, may be followed by a third sound recording. Accordingly, a plurality of sound recordings may be played in response to a greeting card 10 being closed 50. In embodiments, the plurality of sound recordings may be dependent or independent of the first sound recording, the second sound recording, or the plurality of sound recordings.

In the event that the greeting card 10 is closed during the playing of the first sound recording, the closing 50 of the greeting card 10 may trigger a third sound recording to start playing in place of the first sound recording, thus prematurely ending the first sound recording. The third sound recording may be distinct from a second sound recording that is played when the greeting card 10 is closed after the first sound recording has finished playing. Alternatively, the closing 50 of the greeting card 10 during the playing of the first sound recording may prompt the second sound recording to be placed in queue after the first sound recording, where the second sound recording is to be played after the first sound recording has finished playing. In further embodiments, the closing 50 of the greeting card during the play of the first sound recording may cause both the first sound recording and the second sound recording to be played independently, and simultaneously, for a period of time. Additionally, if the greeting card 10 is closed 50, then opened 48, then closed 50 again within a short period of time, the sound recording played in response to the second closing 50 of the greeting card 10 may start from the last position of the second sound recording played in response to the first closing 48 of the greeting card 10, or may start again at the beginning of the second sound recording, or may start at the beginning of a further sound recording distinct from the first and second sound recordings.

In further embodiments, a first sound recording may be played when the greeting card 10 is opened 48, and the first sound recording may continue to play after the greeting card 10 has been closed 50. Additionally, a second sound recording may be played independently once the greeting card 10 has been closed 50, while a third recording may be played in queue after the first sound recording has finished. In other illustrative embodiments, multiple sound recordings may be played upon opening 48 of the greeting card 10. Additionally or alternatively, multiple sound recordings may be played upon closing 50 of the greeting card 10. Further, the multiple sound recordings that may be played upon opening 48 of the greeting card 10 may be associated with an unique sound recording that is played upon closing 50 of the greeting card 10. Additionally, the multiple sound recordings that may be played upon closing 50 of the greeting card 10 may be associated with a unique sound recording that is played upon opening 48 of the greeting card 10.

In embodiments, each sound recording played in accordance with embodiments herein may be played after a predefined timing delay. For example, the playing of the second sound recording may be delayed by 1 second upon closing 50 of the greeting card 10. In this way, users may distinguish between the first sound recording and the second sound recording, instead of confusing the second sound recording as a continuation of the first sound recording. Further, each timing delay may be varied in accordance with alternative embodiments of the present invention.

In further embodiments, the card 10 may have a plurality of messages or sound records thereon, the playback of which may be sequential, random, or both. In an example of a sequential playback arrangement, a first message would be played upon opening, a second message would be played upon closing, a third message would be played upon re-opening, a fourth message would be played upon re-closing, etc. This would require the recipient to interact with the card multiple times to get the full story, message or effect. In the case where a subsequent message would not make sense without the context of the proceeding message(s) (i.e., it is meant to be played in a particular order in a sequence), a reset sequence may be implemented based on the passage of a threshold amount of time. For example, if there are six messages that are intended to be played in sequence and the user stops opening/closing the card after the fourth message is played, the audio message playback device 30 may be reset to start playback at message one again after the passage of an amount of time (e.g., 15 seconds) of non-interaction with the card 10 after the conclusion of the playback of message four. In an example of a random playback arrangement, any one of the plurality of messages could be played back upon opening or closing of the card. In an additional embodiment, the greeting card 10 may play a randomized sound recording in response to opening 48 of the greeting card 10, closing 10 of the greeting card 10, or a combination thereof.

In still further embodiments, a continuation feature may be implemented for instances when the card 10 is closed or opened during the playback of a message. For instance, if a greeting card 10 that is meant to play a first sound recording "Happy Birthday to You" upon opening 48 or closing 50 of the greeting card 10 is cut-off by a user closing 50 or opening 48 the greeting card, respectively, when the first sound recording has only played "Happy Birthday," the recording may resume to finish playing "to You" part of the original recording in response to the user opening 48 or closing 50 the greeting card 10, respectively, within a threshold amount of time. For example, if the first sound recording plays "Happy Birthday" in response to the user opening 48 the greeting card, but the user then closes the greeting card 10 (thereby stopping playback) and subsequently re-opens the greeting card 10 within a threshold amount of time, the first sound recording will continue to play the remainder of the first recording, "to You." However, if the greeting card 10 is re-opened after the threshold amount of time, for example after 15 seconds, the system may reset. In this way, if the first sound recording plays "Happy Birthday" in response to the user opening 48 the greeting card, and the greeting card 10 is re-opened beyond the threshold amount of time, the first sound recording will reset to play the entire first sound recording, "Happy Birthday to You." Further, the sound recording played in response to the user re-opening the greeting card 10 may be dependent upon whether the user re-opens the greeting card within a threshold amount of time.

Figure 4:
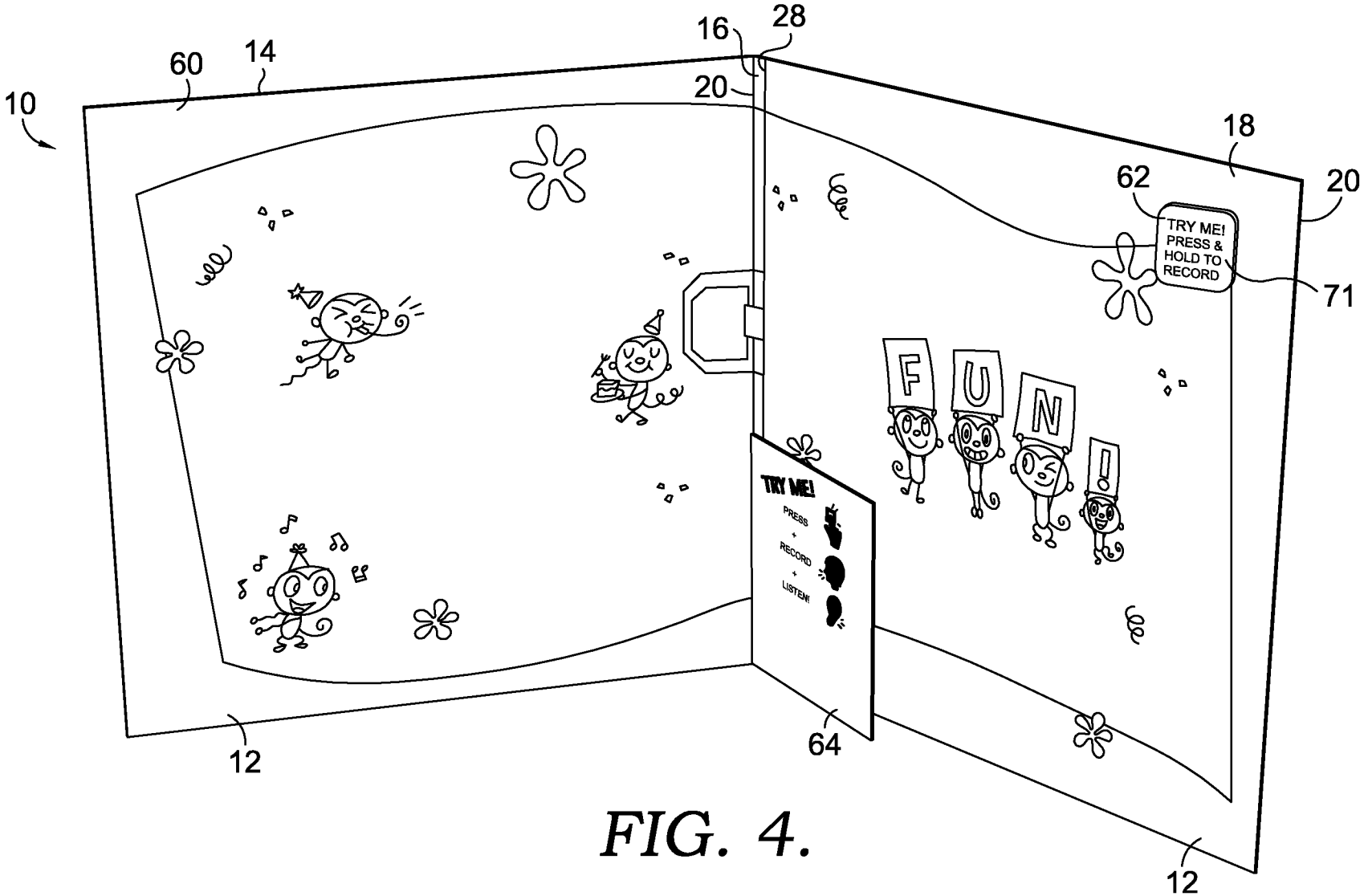

In further embodiments, the greeting card 10 may include a recording component 62, a trial mode component 64, or both. Accordingly, FIG. 4 is a perspective view of an interior of the greeting card 10 of FIG. 2 in an opened position with an additional recording component 62 and an additional trial mode component 64. Accordingly, the greeting card 10 is folded such that the interior cover panel 18 overlies the back panel 16 to define the pocket 28 into which an audio message recording and playback device 66 may be positioned.

Figure 5:
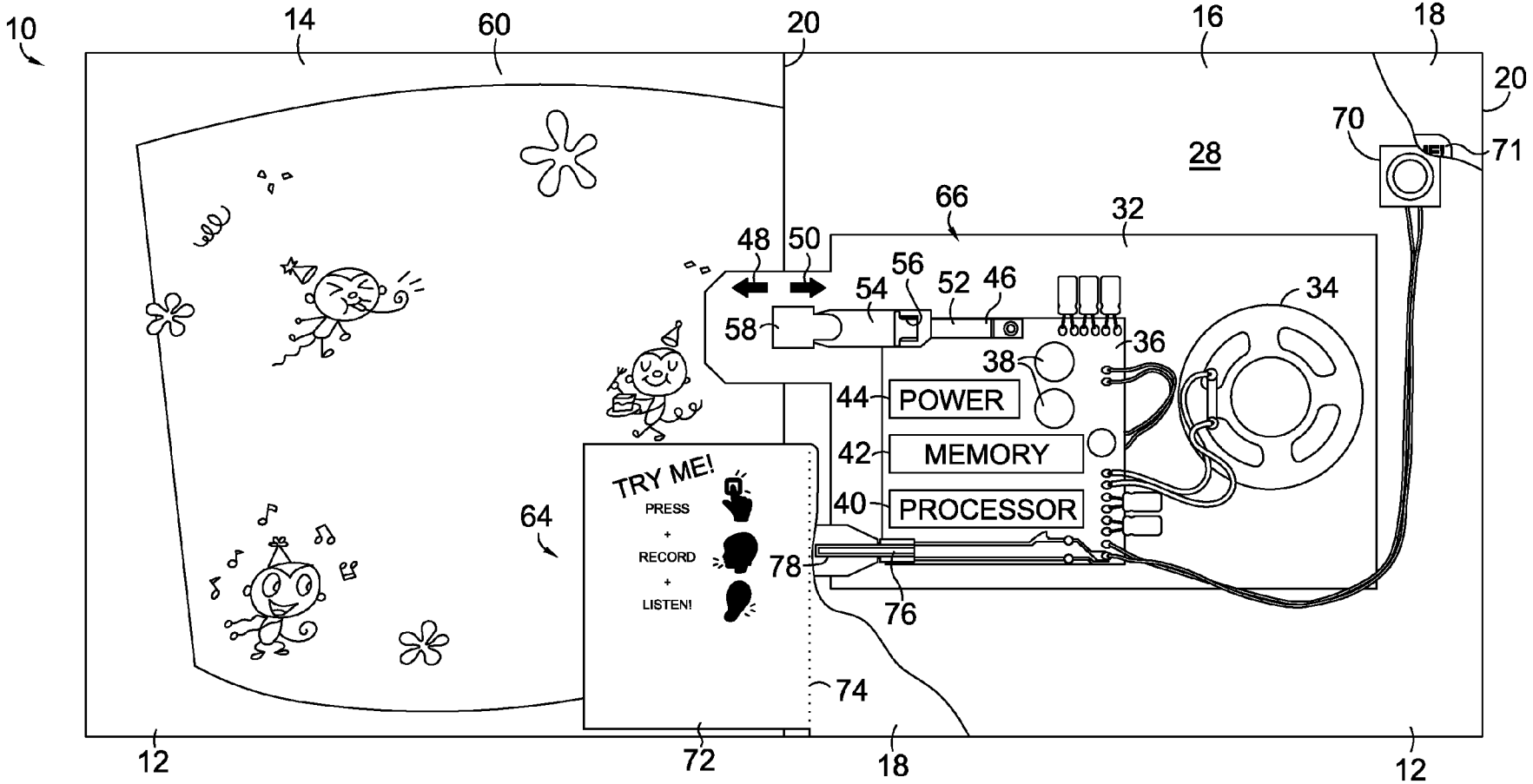

Turning now to FIG. 5, the audio message recording and playback device 66 is illustrated. The audio message recording and playback device 66, for ease of manufacture and assembly of the greeting card 10, includes the components of the audio message playback device 30 as illustrated in FIG. 3. Additionally, the audio message recording and playback device 66 includes a recording component 62 and a trial mode component 64.

The recording component 62 includes a microphone 68 and a second switch 70. In embodiments, microphone 68 may be incorporated into speaker 34. The second switch 70 is configured to provide the audio message recording and playback device 66 with activation of the recording component 62. Accordingly, in the illustrated embodiment, the second switch 70 is implemented as a record button 70. To record a test message, a user presses the record button 70 to initiate a recording session. In the embodiment illustrated in FIG. 4, a removable location label 71 is provided to visibly indicate the position of the record button 70 that is concealed in the pocket 28 between the interior cover panel 18 and the back panel 16. Alternatively, the record button 70 may be indicated by text or a symbol printed on interior cover panel 18 in addition to, or alternative to, removable location label 71.

The user may choose to pinch the record button 70 between his thumb and a finger to initiate the recording session. The recording session may last as long as the record button 70 is depressed or until the capacity of the memory 42 of the audio message recording and playback device 66 is reached. Further, the recorded message is stored in the memory 42. In the illustrated embodiment, the audio message recording and playback device 66 includes a separate speaker 34 and microphone 68. It is to be understood that the two separate devices could be replaced by one combination device and still be within the scope of the present invention. Further, a plurality of play buttons may be placed within greeting card 10, such as concealed in pocket 28. Each of the plurality of play buttons may be associated with a discrete sound recording. To record a personalized sound recording associated with a first play button of the plurality of play buttons, the user may press record button 70 simultaneous with the first play button for the duration of the recording sessions. Recordings may be made for and associated with the remaining play buttons in a similar fashion.

In an illustrative embodiment, the first recording played upon opening 48 of the greeting card 10 is an audio message containing spoken instructions regarding how to record a message for playback using the recording component 62. An example of a possible first message would be, "press and hold button to record your message before the song." The user then records their message as a first recording. In this embodiment, playback of the first recording is immediately followed by a playing of the second recording. For example, the second recording may be a song or music clip. In the illustrated embodiment, the song that correlates with the text and graphics (i.e., the sentiment) on the greeting card 10 is the song "Celebrate" by Three Dog Night. Once the song is played, the audio message recording and playing device 66 waits for further user input.

In further embodiments, the greeting card 10 may include the trial mode component 64, for preventing a person from making a permanent recording until the audio message recording and playback device 66 is placed into a use mode. This prevents a situation where a first person in a store records an inappropriate message on the greeting card 10 and leaves it on the shelf to be subsequently played back to a second unsuspecting person at a later time upon opening 48 the greeting card 10. In this regard, upon closing 50 the greeting card 10, when it is in its trial mode, the audio message recording and playback device 66 reverts to its default procedures and subsequent opening 48 of the greeting card 10 results in playing of the instruction recording followed by the music recording. In particular, the trial mode component 64 includes a trial mode flap 72 that is preferably coupled with the card body 12. In the illustrated embodiment, the trial mode flap 72 is a part of and is cut out from the card stock that forms the card body 12. As such, the trial mode flap 72 may take the form of a fourth flap 72 that is coupled to the cover panel 18 along a perforation line 74. The trial mode flap 72 may be provided with instruction text and/or graphics to inform the user how to record a test message.

The trial mode component 64 may also include a third switch 76. In the illustrated embodiment, the third switch 76 is configured to provide the audio message recording and playback device 66 with activation of the trial mode component 64. Accordingly, in the illustrated embodiment, the third switch 76 is implemented as a tear strip 76 by way of the line of perforation 74 that permits removal of the trial mode flap 72. A portion of the tear strip 76 is coupled with the trial mode flap 72 and another portion of the tear strip 76 is coupled with the circuit board 36. In the embodiment illustrated in FIG. 5 where the tear strip 76 is still one piece, electricity may flow from the circuit board 36 through the path 78 and return back to the circuit board 36, thereby informing the audio message recording and playback device 66 that the trial mode flap 72 is still in place and that the audio message recording and playback device 66 should function in its trial mode. As such, a sound recording(s) recorded during the trial mode should not be permanently recorded. When the trial mode flap 72 is detached from the greeting card 10, the tear strip 76 is torn into two pieces and the path 78 is broken. As a result, the tear switch 76 is moved from a closed circuit to an open circuit, and the change in the state of the tear switch 76 is recognized by the audio message recording and playback device 66. Once the change in the state of the tear switch 76 is recognized, the audio message recording and playback device 66 functions in a use mode. As such, in use mode, the audio message recording and playback device 66 may permanently record a sound recording.

For example, upon completion of recording a test message, the user releases the record button 70. At this point, the audio message recording and playback device 66 automatically initiates playback of the message so that the user may hear his recording. To give the user a more accurate understanding of what it would be like to receive the card, the test message is followed by playing of the second sound recording, in this case the song "Celebrate." Once the message and the song have been played, the audio message recording and playback device 66 waits for subsequent user interaction. For example, the audio message recording and playback device 66 may receive affirmation from the user to permanently record the sound recording. In embodiments when the audio message recording and playback device 66 is in the trial mode, however, there is not a way for the user to permanently record the sound recording without placing the audio message and playback device 66 into the use mode. Once a person purchases the greeting card 10, they may switch the greeting card a 10 from the trial mode to the use mode. As discussed above, this is done by tearing off and/or removing the trial mode flap 72 from the greeting card 10. Once the greeting card 10 has been put in the use mode, the audio message recording and playback device 66 permits repeated playback and permanent recording of a user-recorded message upon opening 48 of the greeting card 10, upon closing 50 of the greeting card 10, or a combination thereof. It is to be understood that an audio message recorded in the trial mode may be permanently recorded in the sense that it is stored indefinitely, until recorded over. However, the trial message is not capable of being played back a second time subsequent to the first time when it was automatically played back.

Figure 6:
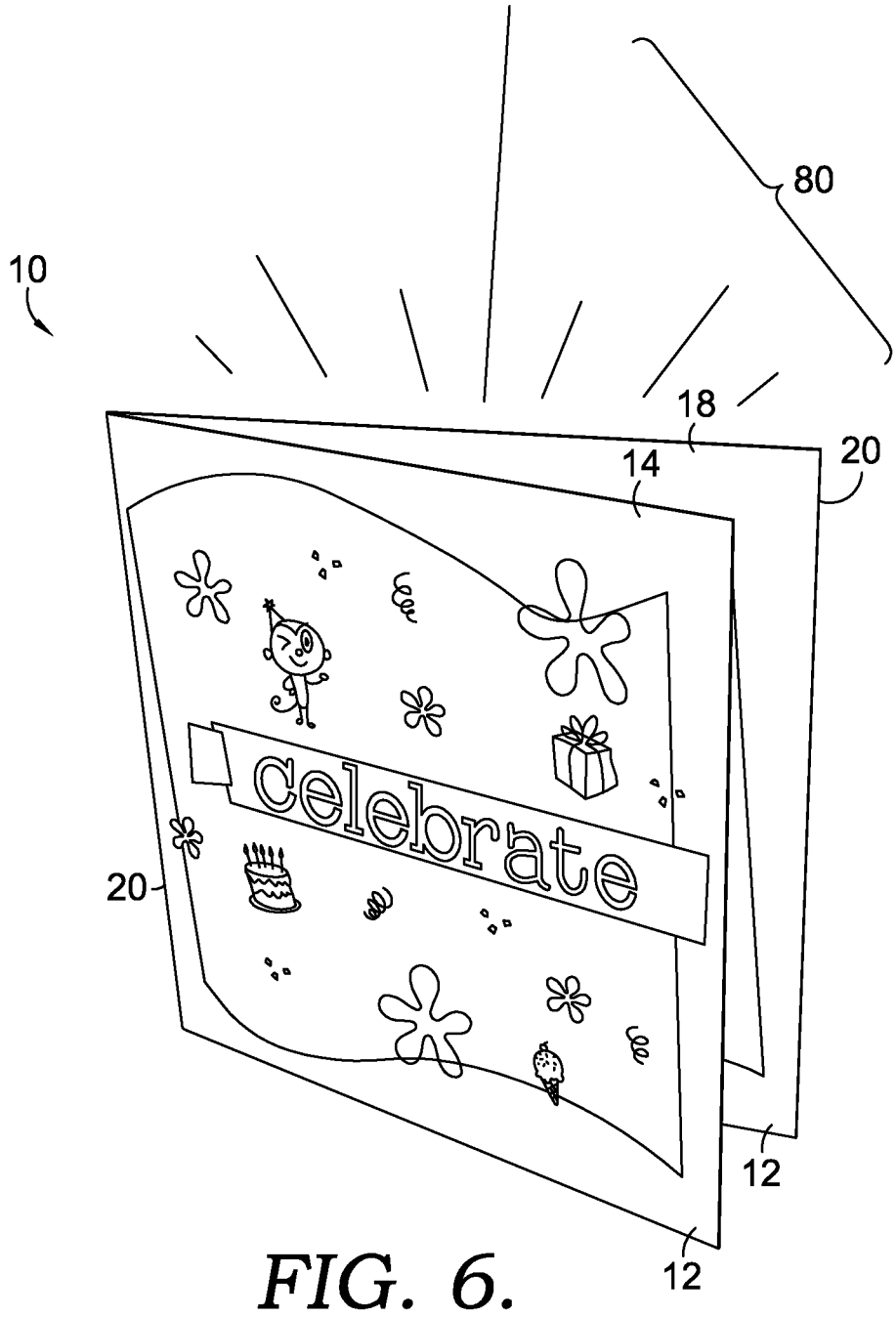

FIG. 6 is a perspective view of an exterior of an almost completely closed greeting card 10 playing a subsequent sound recording 80 upon closing of the card 10 in accordance with embodiments of the present invention. A subsequent sound recording 80 is played upon closing 50 of the greeting card 10, independent of whether a sound recording is played upon opening 48 of the greeting card 10. Further, the sound recording 80 played upon closing 50 of the greeting card 10 may be delayed by a timing component. Additionally, the sound recording 80 played upon closing 50 of the greeting card 10 may be based on the length of time the greeting card 10 is open. The timing of the sound recording 80 played may also be based on the length of time the greeting card 10 is open. For instance, if the greeting card 10 is open for 5 seconds, a first sound recording may be played 7 seconds after the greeting card 10 is closed 50. However, if the greeting card 10 is open for 12 seconds, a second sound recording may be played 10 seconds after the greeting card 10 is closed 50.

Many variations can be made to the illustrated embodiments and/or discussed embodiments of the present invention without departing from the scope of the present invention. Such modifications are within the scope of the present invention. For example, the positions of the switches 46, 70, and 74 can be inverted and the types of switches could be changed. Alternatively, different types of "switches" could be used as would be understood by one of ordinary skill in the art. The term "switches" is used in its broadest sense. Another possible modification would be replacing switch 46 with a light detection mechanism such that opening and closing of the card 10 is recognized by a change in the amount of detected light, thereby sending a signal to the audio message playback device 30 or audio message recording and playback device 66 to initiate a playback sequence. Further, while the user recorded message is followed by the pre-recorded/non-user recorded recording in one of the embodiments discussed above, it is within the scope of the present invention for the user recorded message to be played before, during and/or after the pre-recorded recording. Alternatively, only user recorded messages may be used in other embodiments. For example, a user may record an opening message to be played upon opening, a closing message to be played upon closing and/or an interrupting message to be played in the even the card 10 is closed in the middle of the playback of the opening message. An example of such an interruption message might be, "Hey! That was rude. I wasn't done. Where was I? Oh, yes," at which point the opening message could be continued until completion. Other combinations of user recorded and/or pre-recorded opening, closing and/or interruption messages/songs are within the scope of the present invention. Other modifications would be within the scope of the present invention.

From the foregoing it will be seen that this invention is one well adapted to attain all ends and objects hereinabove set forth together with the other advantages which are obvious and which are inherent to the method and apparatus. It will be understood that certain features and subcombinations are of utility and may be employed without reference to other features and subcombinations. This is contemplated by and is within the scope of the invention. Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. An audio greeting card comprising:

a card body having a plurality of panels, wherein one of the panels is a frontmost panel and one of the panels is a rearmost panel, wherein the greeting card is in a closed position when the frontmost panel and the rearmost panel are generally parallel, and wherein the greeting card is in an open position when the frontmost panel and the rearmost panel are not generally parallel;

an audio message playback device coupled with the card body, the device having a memory component with a first audio message and a second message stored therein, a speaker for playing the first audio message upon closing of the card and for playing the second audio message upon opening of the card, and a power source; and a card status detector, wherein the card status detector detects the closing of the card and the opening of the card, wherein the first audio message is played by the audio message playback device in response to a signal from the card status detector indicating the closing of the card, and wherein the second audio message is played by the audio message playback device upon opening of the card in response to a signal from the card status detector indicating the opening of the card.

2. The audio greeting card of claim 1, further comprising:

a timing component that delays playing the first audio message a pre-determined amount of time after closing of the card.

3. The audio greeting card of claim 1, wherein the closing of the card is determined based on a pre-determined amount of detected light falling below a threshold level.

4. An audio greeting card comprising:

a card body having a plurality of panels, wherein one of the panels is a frontmost panel and one of the panels is a rearmost panel, wherein the greeting card is in a closed position when the frontmost panel and the rearmost panel are generally parallel, and wherein the greeting card is in an open position when the frontmost panel and the rearmost panel are not generally parallel;

an audio message recording and playback device coupled with the card body, the device having a microphone, a memory component for storing a first audio message therein, a speaker for playing the first audio message stored in the memory component upon closing of the card, a power source, a first switch for initiating a message recording session, and a second switch for initiating a message playback session; and a card status detector, wherein the card status detector detects the closing of the card and generates a signal that causes the audio message recording and playback device to play the first audio message in response to detecting the card has transitioned from an open to a closed status.

5. The audio greeting card of claim 4, further comprising:

a timing component that delays playing the first audio message a pre-determined amount of time upon closing of the card.

6. The audio greeting card of claim 5, wherein the pre-determined amount of time is based on the amount of time the card is open prior to the closing of the card.

7. The audio greeting card of claim 4, wherein the card status detector also detects the opening of the card.

8. The audio greeting card of claim 7, wherein the memory component has a second audio message stored therein, wherein the speaker is also for playing the second audio message, and wherein the second audio message is played upon opening of the card.

9. The audio greeting card of claim 4, wherein the first audio message stored in the memory component is a user-recorded audio message.

10. An audio greeting card comprising:

a card body having a plurality of panels, wherein one of the panels is a frontmost panel and one of the panels is a rearmost panel, wherein the greeting card is in a closed position when the frontmost panel and the rearmost panel are generally parallel, and wherein the greeting card is in an open position when the frontmost panel and the rearmost panel are not generally parallel;

an audio message recording and playback device coupled with the card body, the device having a microphone, a memory component for storing a plurality of audio messages therein, a speaker for playing at least one audio message of the plurality of audio messages, a power source, a first switch for initiating a message recording session, and a second switch for initiating a message playback session, wherein a first recorded message of the plurality of audio messages is played upon opening of the greeting card, and wherein a second recorded message of the plurality of the audio messages is played upon closing of the greeting card; and a card status detector, wherein the card status detector detects the opening of the card and the closing of the card and communicates an opening or closing indication to the audio message recording and playback device.

11. The audio greeting card of claim 10, further comprising:

a timing component that delays playing the second recorded message a pre-determined amount of time upon closing of the greeting card.

12. The audio greeting card of claim 10, wherein the first recorded message continues to play after the closing of the greeting card.

13. The audio greeting card of claim 12, wherein the second recorded message plays independently of the first recorded message.

14. The audio greeting card of claim 12, wherein the second recorded message plays after the first recorded message has finished playing.

15. An audio greeting card comprising:

a card body having a plurality of panels, wherein one of the panels is a frontmost panel and one of the panels is a rearmost panel, wherein the greeting card is in a closed position when the frontmost panel and the rearmost panel are generally parallel, and wherein the greeting card is in an open position when the frontmost panel and the rearmost panel are not generally parallel; and an audio message playback device coupled with the card body, the device having a memory component that stores a first audio message and a second audio message therein, a processor that retrieves the first audio message from the memory component in response to receiving a first signal indicating that the greeting card has been opened and that retrieves the second audio message from the memory component in response to receiving a second signal indicating that the greeting card has been closed, a speaker that plays the first audio message after the greeting card has been opened and that plays the second audio message after the greeting card has been closed, and a power source; and a card status detector that detects that the greeting card has been opened and communicates the first signal to the audio message playback device and that the greeting card has been closed and communicates the second signal to the audio message playback device.

16. The audio greeting card of claim 15, further comprising:

a timing component that delays playing the second audio message a pre-determined amount of time after the greeting card has been closed.

17. The audio greeting card of claim 15, wherein the audio message playback device further includes a third audio message, wherein the third audio message is played upon closing of the card if the card is closed while the first audio message is still being played.

18. The audio greeting card of claim 17, wherein the first audio message resumes playback after the third audio message is played.

19. The audio greeting card of claim 18, wherein the second audio message is played upon conclusion of the resumed playback of the first audio message.

20. The audio greeting card of claim 15, wherein the audio message playback device further includes a third audio message, wherein the third audio message is played when the processor receives the second signal while the first audio message is still being played, and wherein the second audio message is played when the processor receives the second signal after the first audio message has concluded playback.

* * * * *